US007340863B1

(12) United States Patent
Dressler

(10) Patent No.: US 7,340,863 B1
(45) Date of Patent: Mar. 11, 2008

(54) ONE PIECE RAIN GUTTER AND LEAF GUARD APPARATUS

(75) Inventor: Robert D. Dressler, Mechanicsburg, PA (US)

(73) Assignee: Amerimax Home Products, Inc., Lancaster, PA (US)

( * ) Notice: Subject to any disclaimer, the term of this patent is extended or adjusted under 35 U.S.C. 154(b) by 480 days.

(21) Appl. No.: 10/786,184

(22) Filed: Feb. 25, 2004

(51) Int. Cl.
*E04D 13/00* (2006.01)

(52) U.S. Cl. ..... 52/12; 52/15; 248/48.1

(58) Field of Classification Search ..... 52/11–16; 248/48.1, 48.2; 210/162–164, 473, 474; 405/119–121
See application file for complete search history.

(56) References Cited

U.S. PATENT DOCUMENTS

| | | | | | |
|---|---|---|---|---|---|
| 891,405 | A * | 6/1908 | Cassens | 210/474 |
| 2,873,700 | A * | 2/1959 | Heier | 52/12 |
| 2,988,226 | A * | 6/1961 | Campbell | 210/474 |
| 3,950,951 | A * | 4/1976 | Zukauskas | 405/119 |
| 4,411,110 | A * | 10/1983 | Carey | 52/11 |
| 4,450,654 | A * | 5/1984 | Clendenin | 52/12 |
| 4,604,837 | A * | 8/1986 | Beam | 52/12 |
| 4,667,448 | A * | 5/1987 | Smith | 52/12 |
| 4,727,689 | A * | 3/1988 | Bosler | 52/12 |
| 4,912,888 | A * | 4/1990 | Martin | 52/12 |
| 4,937,986 | A | 7/1990 | Way | |
| 5,127,200 | A * | 7/1992 | Doran | 52/12 |
| 5,189,849 | A * | 3/1993 | Collins | 52/12 |
| 5,216,852 | A * | 6/1993 | Bemis et al. | 52/12 |
| 5,491,998 | A | 2/1996 | Hansen | |
| 5,575,118 | A * | 11/1996 | Vahldieck | 52/11 |
| 5,619,825 | A | 4/1997 | Leroney | |
| 5,737,879 | A * | 4/1998 | Sweet | 52/12 |
| 5,842,311 | A * | 12/1998 | Morin | 52/12 |
| 6,151,836 | A * | 11/2000 | McGlothlin et al. | 52/11 |
| 6,363,662 | B1 * | 4/2002 | Coates | 52/12 |
| 6,688,045 | B1 * | 2/2004 | Pilcher | 52/12 |
| 6,823,630 | B2 * | 11/2004 | Marra | 52/11 |
| 6,988,335 | B2 * | 1/2006 | Eyers | 52/12 |
| 7,117,643 | B2 * | 10/2006 | Brown | 52/12 |

* cited by examiner

*Primary Examiner*—Yvonne M. Horton
(74) *Attorney, Agent, or Firm*—Miller Law Group, PLLC

(57) ABSTRACT

A one-piece rain gutter and leaf guard apparatus is formed from a single sheet of aluminum. The rain gutter includes a formed trough portion that has a conventional scalloped front aesthetic appearance with a generally vertical back wall and a smooth bottom floor. The leaf guard portion is integrally formed with the trough portion and includes a 180 degree fold that permits generally vertical movement of the leaf guard portion relative to the trough portion. A rear reinforcement flange is formed to project above the trough and leaf guard for mounting of the gutter to the facing board of the roof soffit below the drip edge of the roof. The front edge of the leaf guard is connected to the forward edge of the trough portion by detachable fasteners to provide a rigid support to the forward edge of the gutter trough along the entire length of the gutter.

14 Claims, 2 Drawing Sheets

ONE PIECE RAIN GUTTER AND LEAF GUARD APPARATUS

BACKGROUND OF THE INVENTION

This invention relates generally to a gutter apparatus for collecting rain at the edge of a roof and a leaf guard the covers the gutter apparatus to keep debris from collecting in the gutter.

Rain gutter assemblies are mounted beneath the lowest edge of a roof to collect rain water and melted snow draining by gravity off the surface of the roof. The rain gutter assembly protects the side of the building structure and objects below the edge of the roof from damage due to the water that would otherwise be falling off the lowest edge of the roof. Most rain gutters have an open top into which the draining water is collected into a trough-like structure and drained through a sloped bottom surface of the trough into a down spout for discharge away from the building. Some rain gutters are provided with a cover, commonly referred to as a leaf guard, which is removable from the top surface of the rain gutter to prevent leafs and other debris from falling into and collecting in the trough of the rain gutter and preventing effective drainage to the down spout.

Rain gutters can be constructed from extruded polyvinyl chloride or formed from galvanized steel, aluminum or copper. Typically, the rain gutters are fixed by fasteners to the vertical facing board of the roof structure forming the overall structure of the soffit so that the gutter is positioned immediately beneath the drip edge of the roof structure with the drip edge slightly overlapping the trough. The leaf guard has taken many different configurations, but is typically formed as a separate structure that is mounted in some manner to the upper portion of the rain gutter to cover the open trough.

In U.S. Pat. No. 4,727,689, issued to Kenneth Bosler on Mar. 1, 1988, the rain gutter and leaf guard are formed as a unitary extruded structure that incorporates a mounting lip that detachably engages a clip affixed to the facing board of the roof structure to provide an easily detachable rain gutter structure. While the gutter and leaf guard are formed as a unitary structure, the leaf guard is not removable from the gutter trough to permit access to the trough for maintenance or service thereof. In U.S. Pat. No. 4,937,986, issued to Donald Way, et al on Jul. 3, 1990, the leaf guard structure is a separate formed member that mounts to the roof structure beneath the shingles and is supported on the outer edge of the gutter trough, forming an arched configuration over top of the open trough.

In U.S. Pat. No. 5,216,852, issued to Peter Bemis, et al on Jun. 8, 1993, the gutter and leaf guard structure is formed from a single polyvinyl chloride (plastic) member with a pair of longitudinally-extending living hinges that permit the rain gutter to be assembled into a generally conventionally looking configuration with an integral trough and leaf guard that are connected by mating lips at the rear edge of the trough next to the roof structure. The Bemis gutter and leaf guard structure is formed from a one-piece plastic member, but does not provide an easily convenient removal of the leaf guard for access to the trough for maintenance and service thereof. Furthermore, the Bemis structure has no convenient mounting structure in that the gutter is mounted by fasteners inserted within the interior of the trough. Thus, the unfolded plastic member would have to be mounted to the facing board of the soffit or roof structure before being folded and assembled into the final trough-like configuration.

U.S. Pat. No. 5,491,998, issued to Harry Hansen on Feb. 20, 1996, also reflects a one piece formed gutter and leaf guard apparatus. In the Hansen patent, the leaf guard is an impervious member that terminates in a rolled lip or edge adjacent the front edge of the gutter so that water will drain around the curved lip of the leaf guard while leafs and other debris will be carried off the leaf guard past the front edge of the gutter trough. The formed leaf guard structure in the Hansen patent is unitary and sufficiently rigid as to be self-supported in a cantilevered manner from the rearward edge of the trough. Thus, the Hansen patent also does not provide for a convenient access to the gutter trough for maintenance and service of the gutter structure.

In U.S. Pat. No. 5,619,825, issued to David Leroney, et al on Apr. 15, 1997, the leaf guard is formed as a separate perforated screen member that is mounted on the top of the formed gutter structure to be biased between the rear support of the gutter and the forward edge of the trough, which is formed with a rolled lip to mate with the leaf screen to provide a substantially contiguous surface to permit leaves and debris to be carried off the front edge of the gutter. The rain gutter and leaf guard are supported on longitudinally-spaced gutter supports that are affixed to the facing board by fasteners and project outwardly to engage the front edge of the gutter trough to provide support and rigidity to the gutter structure.

Accordingly, it would be desirable to provide a one-piece gutter and leaf guard apparatus that is integrally formed for assembly and mounting on a soffit facing board beneath the lowest edge of a roof structure in a manner to provide rigidity and integrity for the gutter trough and provide a leaf guard that can be oriented to provide a convenient access to the gutter trough for maintenance and service thereof as needed.

It would also be desirable to provide a one-piece gutter and leaf guard apparatus that is sufficiently rigid in the assembled structure to be self supporting in a cantilevered manner from a fastener attaching the apparatus by a mounting flange to a soffit facing board.

SUMMARY OF THE INVENTION

It is an object of this invention to overcome the disadvantages of the prior art by providing a one piece rain gutter and leaf guard assembly.

It is another object of this invention to provide a one-piece gutter apparatus in which the leaf guard forms a reinforcement support for maintaining the shape of the gutter.

It is a feature of this invention that the gutter apparatus is mounted to the roof acing board with fasteners inserted through a reinforcement flange on which the leaf guard is folded over.

It is an advantage of this invention that the leaf guard flange reinforces the mounting flange of the gutter to provide an adequate support for the mounting of the gutter apparatus.

It is another feature of this invention that the forward edge of the leaf guard is detachably connected to the forward lip of the gutter.

It is another advantage of this invention that the leaf guard portion of the gutter apparatus reinforces the shape of the gutter portion by spanning the upper surface of the gutter portion from the mounting flange to the forward lip.

It is still another feature of this invention that the leaf guard is connected to the front edge of the gutter trough by detachable fasteners.

It is still another advantage of this invention that the leaf guard can be disconnected from the front edge of the gutter trough to permit access to the gutter trough for maintenance and service thereof.

It is still another object of this invention to provide a rain gutter and leaf guard structure that can be manufactured efficiently and installed on-site easily.

It is yet another object of this invention that the gutter and leaf guard structure can be formed from aluminum, steel or copper to provide a long lasting, aesthetically pleasing rain gutter structure.

It is yet another feature of this invention that the rain gutter and leaf guard incorporated a 180 degree fold that operates as a hinge to permit the leaf guard portion to be moved vertically relative to the trough portion for ease of assembly on the building site.

It is still a further object of this invention to provide a rain gutter and leaf guard apparatus, which is durable in construction, inexpensive of manufacture, carefree of maintenance, facile in assemblage, and simple and effective in use.

These and other objects, features and advantages are accomplished according to the instant invention by providing a one-piece rain gutter and leaf guard apparatus formed from a single sheet of aluminum, steel or copper. The rain gutter includes a formed trough portion that has a conventional scalloped front aesthetic appearance with a generally vertical back wall and a smooth bottom floor. The leaf guard portion is integrally formed with the trough portion and includes a 180 degree fold that permits generally vertical movement of the leaf guard portion relative to the trough portion. A rear reinforcement flange is formed to project above the trough and leaf guard for mounting of the gutter to the facing board of the roof soffit below the drip edge of the roof. The front edge of the leaf guard is connected to the forward edge of the trough portion by detachable fasteners to provide a rigid support to the forward edge of the gutter trough along the entire length of the gutter.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
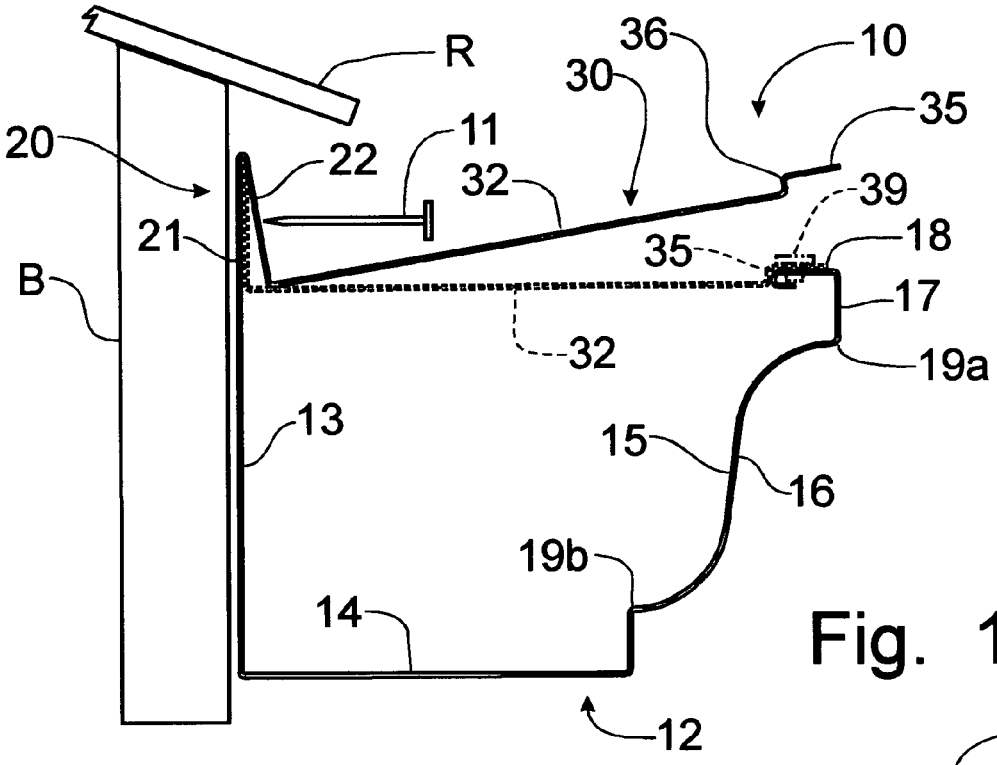
FIG. 1 is a cross-sectional view of the rain gutter and leaf guard apparatus incorporating the principles of the instant invention, the generally vertical movement of the leaf guard portion being shown in phantom in the closed, secured position attached to the forward edge of the gutter trough.
Figure 2:
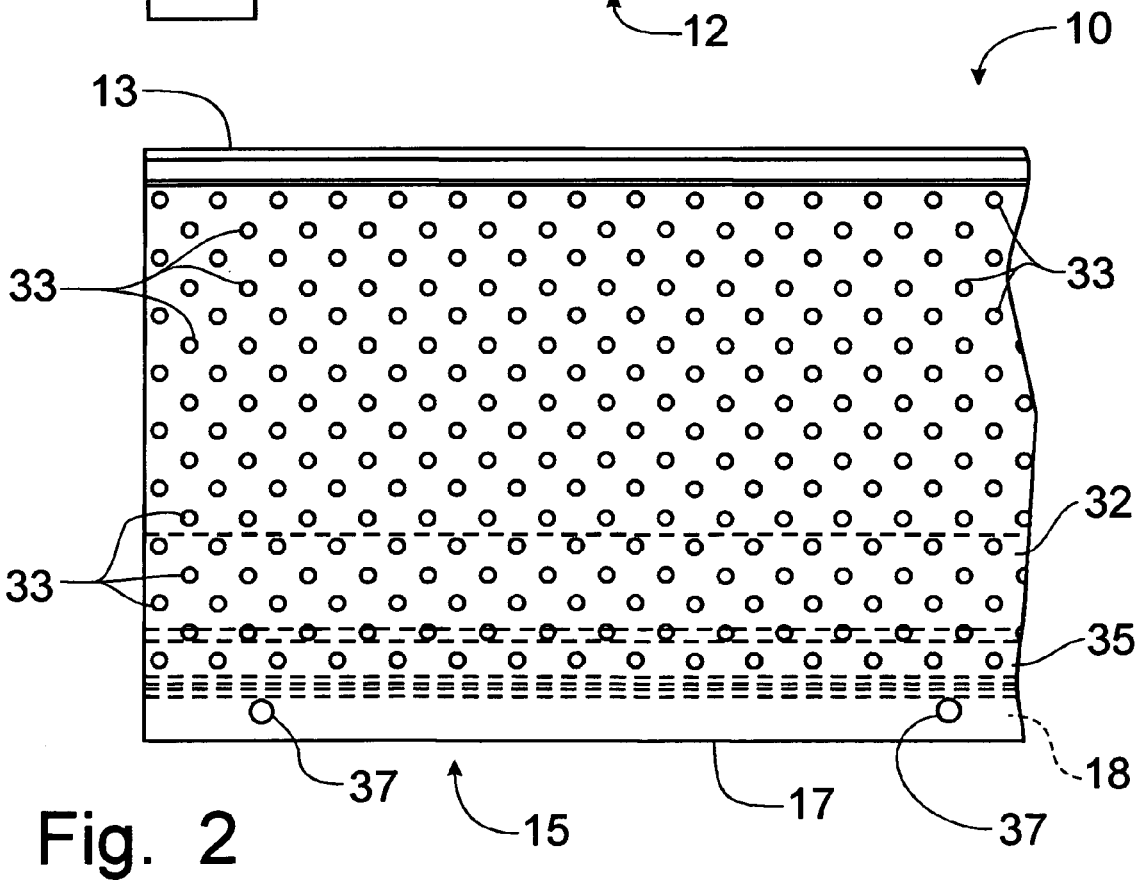
FIG. 2 is a top plan view of the rain gutter and leaf guard structure shown in FIG. 1.
Figure 3:
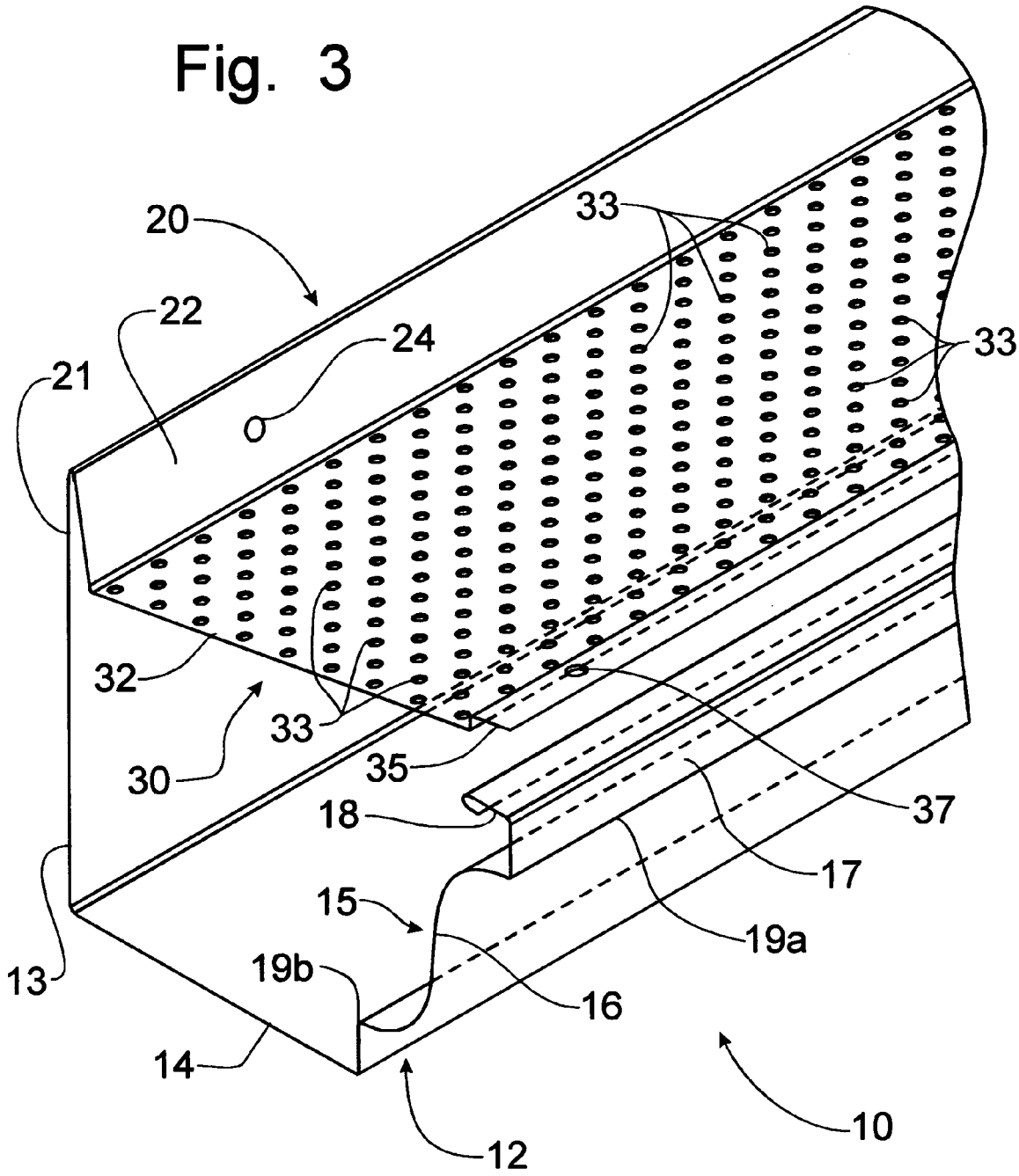
FIG. 3 is a partial perspective view of the rain gutter and leaf guard apparatus shown in FIGS. 1 and 2 with the leaf guard portion vertically separated from the forward edge of the gutter trough.

Referring now to FIGS. 1–3, a rain gutter and leaf guard apparatus incorporating the principles of the instant invention can best be seen. Any references to front and rear, as well as upper and lower, are used as a matter of convenience and are determined in reference to the building to which the rain gutter and leaf guard apparatus 10 are to be mounted with the reference to "rear" being adjacent the building and "front" being the most distant parts away from the building.

The rain gutter and leaf guard apparatus 10 is formed from a single sheet of material, preferably aluminum, although other materials such as copper, galvanized steel and plastic can be used within the scope of the invention. The rain gutter and leaf guard apparatus 10 includes a trough portion 12 and an integral leaf guard portion 30. The trough portion 12 is formed by either stamping, extruding or roll-forming the material such that the front face 15 is formed with an aesthetically pleasing scalloped shape that incorporates a curved surface 16 interconnecting upper and lower 90 degree bends 19*a*, 19*b* that together provide a functional rigidity to the front face 15 of the trough portion 12, as well as a pleasing generally conventional appearance. The front face 15 terminates in a formed upper lip 17 that has a generally horizontally oriented flange 18 positioned above the upper 90 degree bend 19*a*. The trough portion 12 also includes an upright rear wall 13 and a planar floor member 14 that spans between the rear wall 13 and the front face 15.

The rear wall 13 extends upwardly above the upper lip 17 of the front face 15 to form a reinforced mounting flange 20 that is used to mount the rain gutter and leaf guard apparatus 10 to the building B with fasteners 11. The mounting flange 20 is formed with a first portion 21 that is an extension of the rear wall 13 and a second portion 22 which is part of the leaf guard member 30. The second portion 22 is folded into a 180 degree fold from the first portion so that the reinforced mounting flange 20 will have a double thickness of material to support the weight of the rain gutter and leaf guard apparatus 10 from the facing board B. The mounting flange 20 is preferably formed with a hole 24 extending through both the first and second portions 21, 22 so that the fastener 11 will pass through the mounting flange 20 and engage the facing board B.

The leaf guard member 30 is formed in somewhat of an L-shaped configuration with the one leg being the second portion 22 of the mounting flange and the other leg being the perforated body portion 32 of the leaf guard. The body portion 32 is preferably formed with a plurality of drain holes 33, which can be of substantially any configuration or formed as louvers (not shown), extending therethrough to permit the passage of rain water falling from the roof structure R into the trough portion 12 to be carried to a down spout (not shown). The leaf guard portion 30 prevent the passage of leaves and other debris into the trough portion 12, yet allows the passage of water thereto. The front portion of the body member 32 terminates in an attachment lip 35 that is formed with a relief 36 that mates with the horizontal flange 18 of the upper lip 17 on the front face 15. Preferably, both the horizontal flange 18 and the attachment lip 35 are formed with aligned holes 37 that permit the interengagement of a connecting screw 39 that will detachably connect the attachment lip 35 to the horizontal flange 18.

The connection of the leaf guard portion 30 to the upper lip 17 of the trough portion 12 stabilizes the front face 15 of the trough portion 12 by maintaining the upper lip 17 at a fixed distance from the rear wall 13. Thus, the connection between the attachment lip 35 and the horizontal flange 18 adds rigidity to the rain gutter and leaf guard apparatus 10 when installed on the facing board B. Such rigidity permits the one-piece gutter and leaf guard apparatus to be mounted in a cantilevered manner from the soffit facing board by a fastener passing through the mounting flange 20. If access to the interior of the trough portion 12 is desired, the connection screws 39 can be removed allowing the leaf guard portion to separate from the trough portion 12 at the front upper lip 17. Between the flexibility of the trough portion and the 90 degree bend between the second portion 22 and the body member 32 of the leaf guard portion 30, access to the trough portion 12 can be attained for maintenance or service thereof.

In operation, the formed rain gutter and leaf guard apparatus 10 is positioned against the facing board B, preferably with the attachment lip 35 already connected to the upper lip 17 by the connecting screws 39, and the apparatus is oriented in a conventional manner so that the bottom floor surface 14 is sloped toward a down spout (not shown). A fastener 11 is then inserted through the hole 11 through the reinforced mounting flange 20 and engaged into the facing board B.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A rain gutter and leaf guard apparatus comprising:

a trough portion having a front face, a rear wall and a bottom floor interconnecting said front face and said rear wall, said front face terminating at an upper lip said upper lip being formed with a horizontal flange extending inwardly toward said rear wall from said front face;

a leaf guard portion formed integrally with said trough portion and extending from said rear wall to said upper lip, said leaf guard portion terminating in an attachment lip positioned proximate to said upper lip of said trough portion;

a connecting member interengaging said attachment lip and said upper lip to connect said leaf guard portion to said trough portion, said attachment lip mating with said horizontal flange to permit said connecting member to interengage said attachment lip and said horizontal flange; and a mounting flange formed by an extension of said rear wall above said upper lip and a leg member of said leaf guard portion that is oriented parallel to said rear wall, said leg member being folded over from said rear wall extension by a 180 degree bend.

2. The rain gutter and leaf guard apparatus of claim 1 wherein said mounting flange is formed with holes therein extending though both said leg member and said rear wall extension for the passage of a fastener through said mounting flange into a support structure to which said rain gutter and lead guard apparatus is to be mounted.

3. The rain gutter and leaf guard apparatus of claim 1 wherein said leaf guard further includes a body member oriented generally perpendicularly to said leg member, said body member terminating at said attachment lip.

4. The rain gutter and leaf guard apparatus of claim 3 wherein said body member is formed with drain holes therein for the passage of water through said leaf guard portion into said trough portion.

5. The rain gutter and leaf guard apparatus of claim 4 wherein said front face is formed in a scalloped shape including a curved surface extending between spaced apart 90 degree bends.

6. In a rain gutter having a trough including a front face terminating at an upper lip, a rear wall opposing said front face, and a bottom floor member extending between said rear wall and said front face, said trough having a generally open top to collect water therein, the improvement comprising:

a leaf guard formed integrally with said trough and extending from said rear wall to said upper lip to close said open top of said trough, said leaf guard having a leg member integrally formed with said rear wall and a body portion that extends generally perpendicularly to said leg member to terminate at an attachment lip which is connected to said upper lip by detachable connecting members, said upper lip being formed with a horizontal flange extending inwardly toward said rear wall from said front face, said attachment lip being formed with a recess to mate with said horizontal flange and permit said connecting members to interengage said attachment lip and said horizontal flange.

7. The rain gutter of claim 6 wherein said rear wall includes an extension that projects vertically above said upper lip, said rear wall extension and said leg member forming a mounting flange for engagement with a fastener that connects said mounting flange to a support structure on which said rain gutter is to be mounted.

8. The rain gutter of claim 7 wherein said mounting flange is formed with holes therein extending though both said leg member and said rear wall extension for the passage of said fastener through said mounting flange into said support structure.

9. The rain gutter of claim 7 wherein said body member is formed with drain holes therein for the passage of water through said leaf guard portion into said trough portion.

10. The rain gutter of claim 7 wherein said front face is formed in a scalloped shape including a curved surface extending between spaced apart 90 degree bends.

11. A rain gutter apparatus comprising:

a trough portion having a front face, a rear wall and a bottom floor interconnecting said front face and said rear wall, said front face terminating at an upper lip being formed with a horizontal flange extending inwardly toward said rear wall from said front face;

a leaf guard portion extending from said rear wall to said upper lip, said leaf guard portion including a leg member that is integrally formed with said rear wall and a body member that is integrally formed with said leg member and extends generally perpendicularly thereto, said body member terminating in an attachment lip positioned proximate to said upper lip of said trough portion;

a mounting flange formed by an extension of said rear wall vertically above said upper lip and said leg member of said leaf guard portion, said leg member being folded through a 180 degree bend to orient said leg member parallel to said rear wall extension; and a connecting member interengaging said attachment lip and said upper lip for detachably connecting said leaf guard portion to said trough portion, said attachment lip being formed with a recess to mate with said horizontal flange and permit said connecting member to interengage said attachment lip and said horizontal flange.

12. The rain gutter apparatus of claim 11 wherein said recess positions said attachment lip above said body member.

13. The rain gutter apparatus of claim 11 wherein said mounting flange is formed with holes therein extending though both said leg member and said rear wall extension for the passage of a fastener through said mounting flange into a support structure to which said rain gutter and lead guard apparatus is to be mounted.

14. The rain gutter apparatus of claim 13 wherein said body member is formed with drain holes therein for the passage of water through said leaf guard portion into said trough portion.

* * * * *